US007971954B2

(12) United States Patent
Ito

(10) Patent No.: US 7,971,954 B2
(45) Date of Patent: Jul. 5, 2011

(54) RECORDING APPARATUS AND METHOD OF CONTROLLING RECORDING APPARATUS

(75) Inventor: Keigo Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 344 days.

(21) Appl. No.: 12/389,477

(22) Filed: Feb. 20, 2009

(65) Prior Publication Data

US 2009/0214228 A1 Aug. 27, 2009

(30) Foreign Application Priority Data

Feb. 22, 2008 (JP) ..... 2008-041077

(51) Int. Cl.
*B41J 2/165* (2006.01)

(52) U.S. Cl. ..... 347/16; 347/5; 347/84

(58) Field of Classification Search ..... 347/5, 9, 347/14, 16, 19, 84
See application file for complete search history.

(56) References Cited

U.S. PATENT DOCUMENTS 5,717,443 A * 2/1998 Numata et al. ..... 347/16
7,287,842 B2 * 10/2007 Aruga ..... 347/84

FOREIGN PATENT DOCUMENTS

JP 2000-141814 5/2000
JP 2005-066969 3/2005
JP 2005-297331 10/2005

* cited by examiner

*Primary Examiner* — Lam S Nguyen
(74) *Attorney, Agent, or Firm* — Workman Nydegger

(57) ABSTRACT

A recording apparatus having a transporting unit to transport a target, a recording unit recording on the target transported, a fluid supply adjusting unit to switch an operation between supply and non-supply of fluid from a fluid supply source, a drive source for the transporting unit and the fluid supply adjusting unit, a control unit to control the drive source, a jam detection unit to detect a jam of the target, a storage unit to retain jam data, a determining unit configured to determine the presence or absence of occurrence of the jam, wherein the control unit carries out a first control or a second control according to the detection of the jam when the power is turned OFF and carries out a third control or a fourth control according to the state of occurrence of the jam when the power is turned ON.

3 Claims, 9 Drawing Sheets

RECORDING APPARATUS AND METHOD OF CONTROLLING RECORDING APPARATUS

BACKGROUND

1. Technical Field

The present invention relates to a recording apparatus such as a printer and, more specifically, to a recording apparatus configured to perform a predetermined control in case of occurrence of a jam (paper jam) in a configuration in which a supply mechanism of fluid such as ink and a transporting mechanism for a target such as a paper are driven by a common drive source and a method of controlling the recording apparatus.

2. Related Art

In the related art, in a printer as the recording apparatus of the type described above, printing of images or characters are achieved by carrying out recording (printing) by a printhead on a transported paper (target).

For example, a printer which carries out a paper discharging process for removing a paper from a transport path in case of occurrence of the jam, which is an event that a paper is lodged at some points of the transport path, is disclosed (for example, JP-A-2005-66969, JP-A-2000-141814).

JP-A-2005-66969 discloses a printing apparatus configured to store jam data relating to whether the paper jam is occurred or not in a storage unit when the power of is turned OFF and, if the paper jam is occurred when the power is turned OFF, and there is any sensor which detects and the presence of paper at the time when the power of the printing apparatus is turned ON from among sensors which have detected the presence of paper at the time when the power is turned OFF, not to carry out a paper discharging process which is to be carried out in a normal condition (non-error condition) as a paper jam error.

JP-A-2000-141814 discloses a configuration in which when a paper is present (a paper detection sensor is turned ON) and a carriage is out of its home position when a main power is turned ON, it is determined that there is a probability of the paper jam, so that a jam paper discharging routine is carried out to remove the paper, and a CR home seek process is carried out.

There is also a known printer which employs an ink supply system in which a pressurizing pump for pressurizing an ink pack in an ink cartridge, and ink is supplied by pressurization from the ink pack to a printhead by pressurizing the interior of the ink cartridge by the pressurizing pump (for example, JP-A-2005-297331).

For example, in a printer having a pressurizing pump as described in JP-A-2005-297331, when a common power motor is employed as a drive source for carrying out a paper-feeding process or the paper discharging process and a drive source for the pressurizing pump for reducing the number of components, the pressurizing pump must be turned ON when applying an ink supply pressure to the ink cartridge when turning the power ON. However, if the power motor is driven for driving the pressurizing pump when the power is turned ON in a state in which the paper jam is occurred, a force to move the paper is exerted in the feeding direction or in the reverse direction via a paper feeding mechanism, so that the state of paper jam might become worse.

For example, in the printing apparatus disclosed in JP-A-2005-66969, the jam is prevented from getting worse by not performing an automatic paper discharging operation when the jam is occurred. However, in the printing apparatus which does not include the automatic paper discharging operation, since the pressurizing pump is driven for securing the ink supply pressure when the power is turned ON, there is a problem of aggravating the jammed state.

SUMMARY

An advantage of some aspects of the invention is to provide a recording apparatus configured to drive a transporting unit and a fluid supply adjusting unit by a power of a common drive source, in which an event such that a jam is aggravated by the fluid supply adjusting unit operated when a power of the recording apparatus is turned ON for supplying fluid from a fluid supply source to a recording unit even though a jam of a target is not solved is avoided, and a method of controlling the recording apparatus.

A recording apparatus having a transporting unit configured to transport a target and a recording unit configured to carry out recording on the target transported by the transporting unit includes: a fluid supply adjusting unit configured to switch the operation between supply and non-supply of fluid from a fluid supply source in which fluid for recording is stored to the recording unit; a drive source common for the transporting unit and the fluid supply adjusting unit; a control unit configured to control the drive of the drive source; a jam detection unit configured to detect a jam of the target on a transport path of the transporting unit; a storage unit configured to retain jam data on the basis of the result of detection of the jam detection unit; and a determining unit configured to determine the presence or absence of occurrence of the jam at the time of the last power-OFF operation on the basis of the jam data in the storage unit when the power of the recording apparatus is turned ON, and the control unit drives the drive source for causing the fluid supply adjusting unit to supply the fluid from the fluid supply source to the recording unit when the jam is not occurred on the basis of the result of determination of the determining unit when the power of the recording apparatus is turned ON, and does not drive the drive source to be carried out for causing the fluid supply adjusting unit to supply the fluid from the fluid supply source to the recording unit when the jam is occurred.

According to the invention, when the jam of the target on the transport path of the transporting unit is detected by the jam detection unit, the jam data on the basis of the result of detection of the jam detection unit is retained in the storage unit. When the power of the recording apparatus is turned OFF and then turned ON for the next time, the determining unit determined whether or not the occurrence of the jam is present at the time of the last power-OFF operation on the basis of the jam data in the storage unit. Then, the control unit drives the power source for causing the fluid supply adjusting unit to supply the fluid from the fluid supply source to the recording unit when the jam is not occurred on the basis of the result of determination of the determining unit. On the other hand, when the jam is occurred, the drive of the drive source to be carried out for causing the fluid supply adjusting unit to supply the fluid from the fluid supply source to the recording unit is not carried out. Therefore, at the time of the next power-ON operation after the power is turned OFF under the state in which the jam is occurred, the drive of the drive source to be carried out for causing the fluid supply adjusting unit to supply the fluid from the fluid supply source to the recording unit is not carried out. Therefore, the transporting unit having the common drive source is not driven, and hence an event such that the jam is made worse is avoided even when the jam is not cleared when the power source is turned ON.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Referring now to FIG. 1 to FIG. 8, a first embodiment in which the invention is applied to a printing apparatus will be described.

Figure 1:
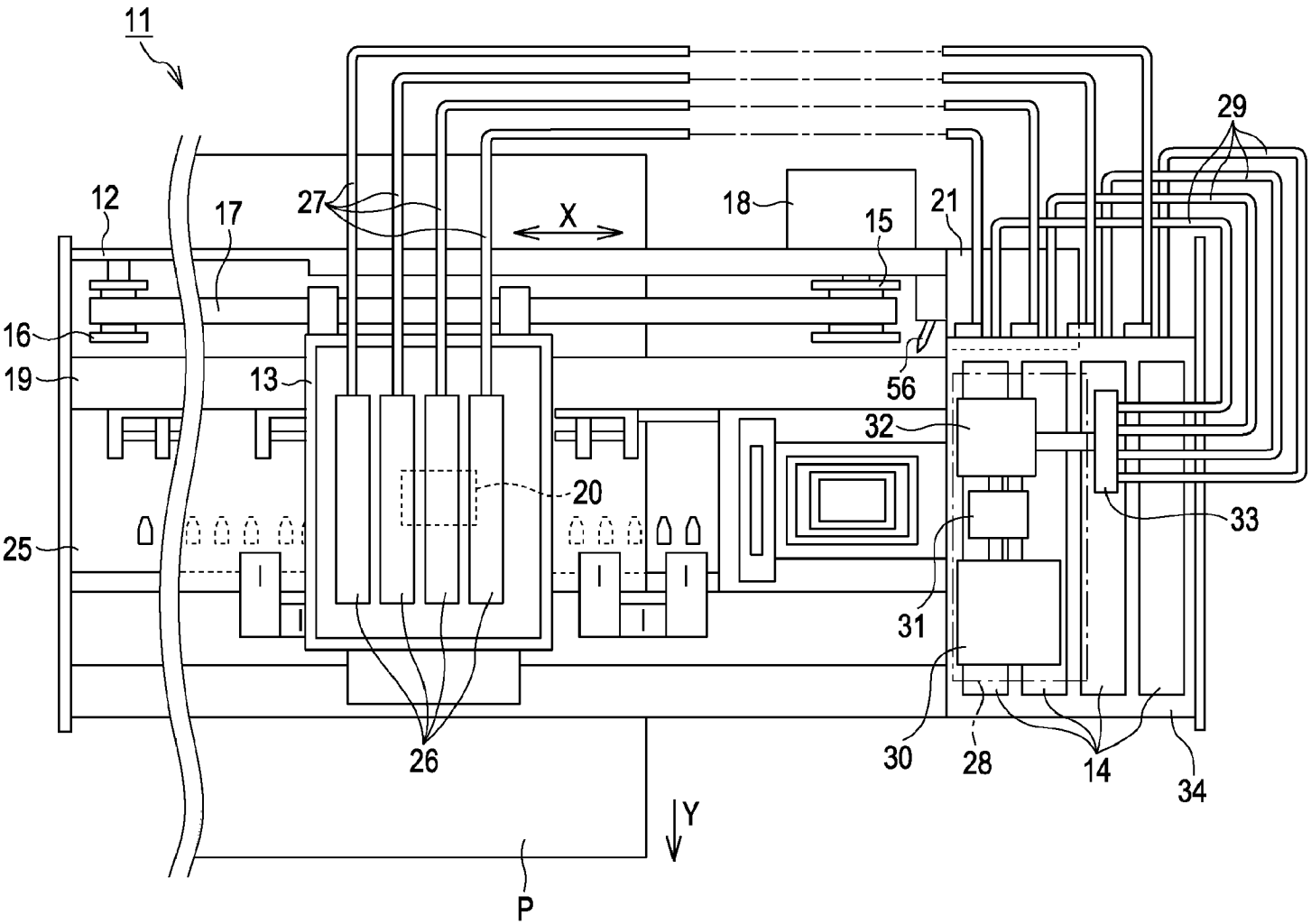
FIG. 1 is a schematic plan view of a printer according to a first embodiment.

FIG. 1 is a plan view showing a schematic configuration of the interior of an external case of the printing apparatus. An ink jet printing apparatus 11 as a recording apparatus includes a carriage 13 and ink cartridges 14 in a body case 12, and has an off-carriage configuration in which the ink cartridges 14 are arranged on the side of the body case 12 at a position away from the carriage 13. The carriage 13 is fixed to a predetermined position of a timing belt 17 in the shape of an endless belt, which is wound around a drive pulley 15 and a driven pulley 16, is guided by a guide shaft 19 by the timing belt 17 being driven to rotate in the normal direction and the reverse direction by a carriage motor (hereinafter referred to as a CR motor 18), and reciprocates in a primary scanning direction X (lateral direction in FIG. 1). The ink cartridges 14 correspond to a fluid supply source.

A printhead 20 as a recording unit having a plurality of nozzle holes is mounted to a lower portion of the carriage 13. A transporting motor as a drive source for transporting a paper P as a target (hereinafter, referred to as "PF motor 21") is mounted on the side of an end portion (the side of a right end portion in FIG. 1) of the body case 12. A pinion gear 21*a* fitted on an output shaft of the PF motor 21 (see FIG. 2) is connected to a transporting roller 22 and a paper discharging roller 23 (see FIG. 5) via a gear mechanism 24 so as to be capable of transmitting a power. When the PF motor 21 is driven to rotate, the transporting roller 22 and the paper discharging roller 23 rotate, and the paper P is transported on a platen 25 in a secondary scanning direction Y (vertical direction in FIG. 1).

As shown in FIG. 1, a plurality of valve units 26 are mounted on top of the carriage 13. The ink cartridges 14 and the valve units 26 are provided by the same number as the colors of ink (for example, black, yellow, magenta, and cyan), and the respective valve units 26 are connected to the ink cartridges 14 of respective colors via ink supply tubes 27 by respective colors. The respective valve units 26 temporarily store ink supplied from the ink cartridges 14 and supply the ink adjusted in pressure to a predetermined pressure to the printhead 20.

Disposed at an end portion of the body case 12 (the right end portion in FIG. 1) above the ink cartridges 14 is a pressurizing unit 28. The pressurizing unit 28 is an apparatus for delivering pressurized air to the ink cartridges 14 via air supply tubes 29, and includes a pressurizing pump 30, a pressure sensor 31, and an atmospheric air release valve 32. Air pressurized by the pressurizing pump 30 is supplied to respective internal spaces (hereinafter, referred to as "air chamber") of the ink cartridges 14 of respective colors mounted on a cartridge holder 34 via the plurality of (four in this embodiment) air supply tubes 29 connected to a distributor 33 via the pressure sensor 31 and the atmospheric air release valve 32 (closed state).

Ink packs 35 (see FIG. 5) having ink encapsulated therein are stored respectively in ink cases 14*a* as exterior cases of the ink cartridges 14 and, in a state in which the ink cartridges 14 are mounted on the cartridge holder 34, the ink supply tubes 27 are connected to ink discharge ports 35*a* (see FIG. 5) of the ink packs 35 and air chambers in the ink cases 14*a* are in communication with the air supply tubes 29. When the pressurizing pump 30 is activated, and pressurized air is supplied to the air chambers in the ink cartridges 14 via the air supply tubes 29, the ink packs 35 are pressurized by the air pressure in the air chambers, so that ink in the ink packs 35 is supplied to the valve units 26 via the ink supply tubes 27.

Ink stored temporarily in the valve units 26 is supplied to the printhead 20 while being adjusted in pressure by pressure adjusting valve mechanisms in the valve units 26. The printing apparatus 11 drives the CR motor 18 and the PF motor 21 on the basis of print data read from a host computer HC (shown in FIG. 5) or a memory card and carries out a printing process by discharging ink from the printhead 20.

Figure 2:
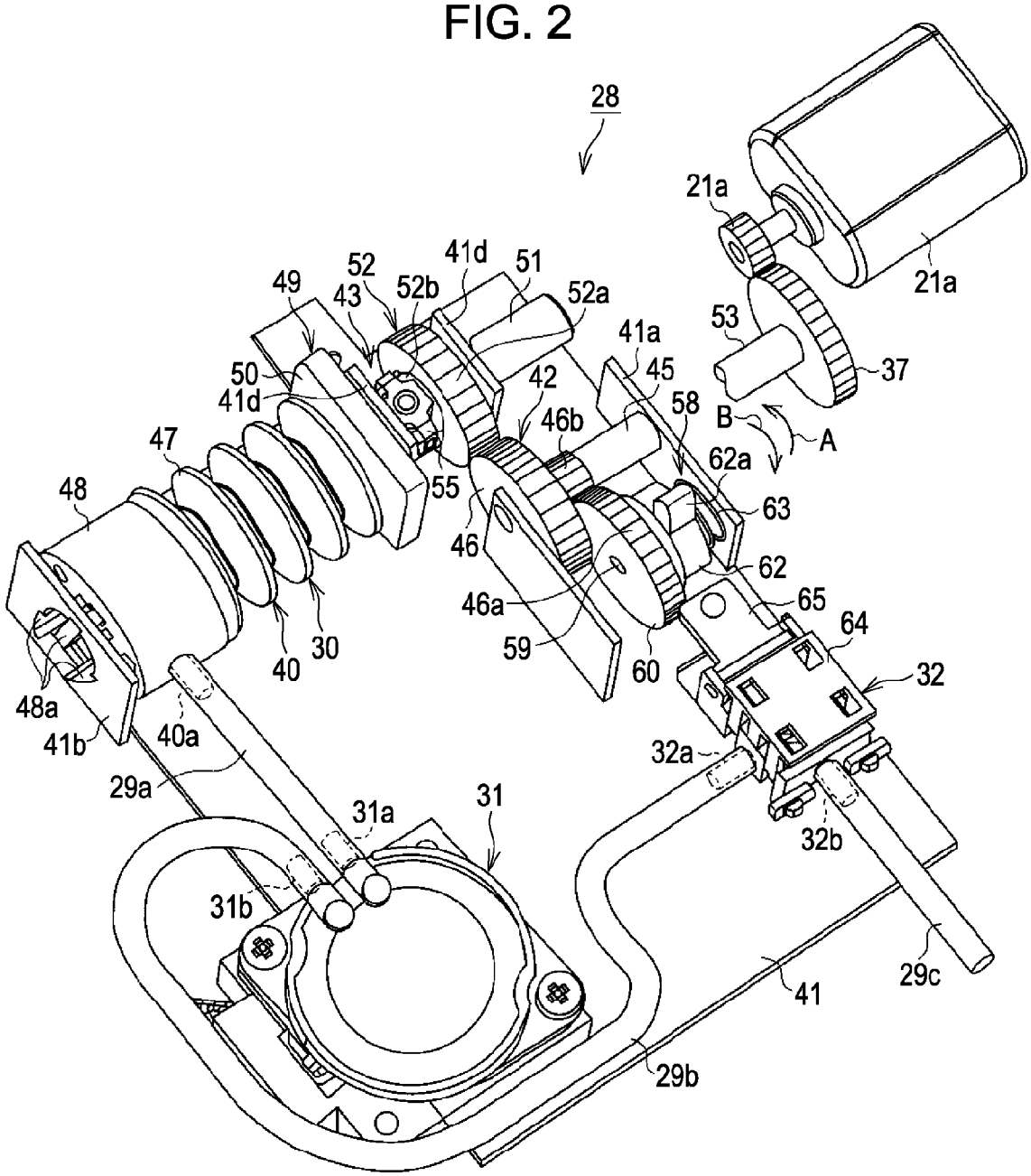
FIG. 2 is a perspective view of a pressurizing unit.

FIG. 2 is a perspective view of the pressurizing unit 28. The pressurizing unit 28 is unitized by the pressurizing pump 30, the pressure sensor 31, and the atmospheric air release valve 32 being mounted on a metallic mounting panel 41. The pressurizing pump 30 in this example is a bellows-type pump, and employs a PF motor 21 as a drive source. The rotation of the PF motor 21 is transmitted to a gear mechanism 42 via a clutch mechanism 54 (shown in FIG. 5), and is transmitted from the gear mechanism 42 to an input gear 52 of the pressurizing pump 30, thereby being converted into a reciprocating linear motion of a pump unit 40 via a cam mechanism 43 which rotates integrally with the input gear 52.

More specifically, as shown in FIG. 2, a revolving shaft 53 of a gear 37 which engages the pinion gear 21*a* fitted on the output shaft of the PF motor 21 is connected to a revolving shaft 45 of a first gear 46 via the clutch mechanism 54 (see FIG. 5) so as to be capable of transmitting the power. The first gear 46 includes a large diameter gear 46*a* and a small diameter gear 46*b*, and the large diameter gear 46*a* engages the input gear 52 of the cam mechanism 43 which constitutes the pressurizing pump 30.

As shown in FIG. 1, a clutch lever 56 operated by the carriage 13 is provided at a predetermined switching position on the side of the home position (a position to the right end in FIG. 1) on a moving path of the carriage 13. When the carriage 13 is moved to the switching position and presses the clutch lever 56 inward, the clutch mechanism 54 is switched to a connected state in which the power of the PF motor 21 can be transmitted to the pressurizing unit 28, and in contrast, when the carriage 13 is moved away from the switching position, the clutch lever 56 is restored by a restoring force of a spring, not shown, so that the clutch mechanism 54 is disconnected.

The pump unit 40 which constitutes the pressurizing pump 30 shown in FIG. 2 includes a bellows 47, and a lid member 48 and a pressing member 49 hermetically secured to both ends of the bellows 47. The lid member 48 is locked and secured to a holding wall 41*b* of the mounting panel 41 via a plurality of claw portions 48*a*. In contrast, the pressing member 49 includes a base member 50 formed into a flat panel shape and a cylindrical driving rod 51 extending vertically from one surface of the base member 50.

As shown in FIG. 2, the pressing member 49 is supported so as to be capable of reciprocating linear motion in a state in which the driving rod 51 thereof is inserted into supporting holes (not shown) opened on a pair of supporting strips 41*d* and 41*d* formed by bending the mounting panel 41.

The input gear 52 is supported rotatably about the driving rod 51 between the pair of supporting strips 41*d* and 41*d* by the driving rod 51 being inserted into a communication hole (not shown) penetrating therethrough along the axial line thereof. The input gear 52 includes a tooth portion 52*a* of a large diameter portion and a cylindrical portion 52*b* of a small diameter portion, and the tooth portion 52*a* of the large diameter portion engages the large diameter gear 46*a* of the first gear 46 described above.

Formed on the outer peripheral surface of the driving rod 51 is a cam groove (not shown) having a groove path including a double helix connected at the both ends, and a cam portion (not shown) is held by a holding strip 55 mounted on the cylindrical portion 52*b* so as to be in fitted into the cam groove. When the input gear 52 rotates in one direction, the cam portion rotates around the driving rod 51 by being guided by the cam groove correspondingly, whereby the pressing member 49 reciprocates in the direction of axis of the driving rod 51, thereby causing the bellows 47 to be expanded and contracted. With the function of a valve mechanism (not shown) built in the lid member 48, a check valve (not shown) in an intake channel is opened to intake air in the course of expansion of the bellows 47 and, in contrast, a check valve in an exhaust channel is opened in the course of contraction of the bellows 47 to exhaust the pressurized air from an exhaust connecting pipe 40*a*.

As shown in FIG. 2, the pressure sensor 31 is a sensor which detects a pressure of the pressurized air that the pressurizing pump 30 discharges, and is able to output a detected value according to the pressure. The pressure sensor 31 is connected in such a manner that an input connecting pipe 31*a* as an entrance of the pressurized air is connected to the exhaust connecting pipe 40*a* of the pressurizing pump 30 via a first air supply tube 29*a*, and an output connecting pipe 31*b* is connected to a suction connecting pipe 32*a* of the atmospheric air release valve 32 via a second air supply tube 29*b*. The pressure sensor 31 communicates with air chambers in the ink cartridges 14 via the atmospheric air release valve 32, and the detected values indicate the air pressures in the ink cartridges 14.

Opening and closing the atmospheric air release valve 32 shown in FIG. 2 is carried out by using the power of the PF motor 21. As shown in FIG. 2, a frictional clutch mechanism 58 is disposed between the first gear 46 and the atmospheric air release valve 32. More specifically, a second gear 60 is rotatably provided at the distal end portion of a spindle 59 which is secured to a wall portion 41*a* of the mounting panel 41. The second gear 60 engages the small diameter gear 46*b* of the first gear 46. A swing lever 62 which may be rotated in association with the second gear 60 by the frictional clutch mechanism 58 is rotatably supported on the spindle 59 between the second gear 60 and the wall portion 41*a*. Formed on the outer peripheral surface of the swing lever 62 is a lever portion 62*a* projecting in the radial direction thereof.

A compression spring for urging the swing lever toward the second gear 60 (hereinafter, referred to as "first spring 63" is interposed between the swing lever 62 and the wall portion 41*a*. The second gear 60 and the swing lever 62 are in frictional contact at both contact surfaces (frictional clutch surfaces) of the both members by a pressing force applied by an urging force of the first spring 63, and function as the frictional clutch. In other words, in a state in which no load is applied to the swing lever 62, when the second gear 60 rotates, the swing lever is rotated in association with the rotation of the second gear 60 via a frictional force generated at the frictional clutch surfaces and, when a load larger than the predetermined value is applied to the swing lever 62, slippage is generated on the frictional clutch surfaces and hence the second gear 60 is idled, so that the swing lever does not rotate any more. A load equal to or larger than the predetermined value is applied to the swing lever 62 when the lever portion 62*a* comes into abutment with the spindle 59 and when a valve opening lever 65 of the atmospheric air release valve 32 is pushed inward to the end.

When the PF motor 21 rotates, the second gear 60 rotates via the first gear 46 and, in association with this, the swing lever 62 rotates in the same direction as the second gear 60 via the connection with the frictional clutch mechanism 58. Since the PF motor 21 is capable of rotating in the normal direction and the reverse direction, it is assumed in this example that the swing lever 62 rotates the lever portion 62*a* in the direction opposite from the atmospheric air release valve 32 (that is, the direction indicated by an arrow A in FIG. 2) when the PF motor 21 rotates in the normal direction, and rotates toward the atmospheric air release valve 32 (that is, the direction indicated by an arrow B in FIG. 2) when the PF motor 21 rotates in the opposite direction.

When the PF motor 21 rotates in the normal direction (however, under the state in which the clutch mechanism 54 (see FIG. 5) is connected), the atmospheric air release valve 32 is closed by a restoring force of a spring (hereinafter, referred to as a "second spring 69") (shown in FIG. 3 and FIG. 4) by the swing lever 62 rotating in the direction of an arrow A and the valve opening lever 65 of the atmospheric air release valve 32 being released from the pushed-in state. The direction of normal rotation of the PF motor 21 matches the direction to rotate the transporting roller 22 in the paper-feeding direction (paper discharging direction) and, on the basis of the rotating force, the atmospheric air release valve 32 is closed and the bellows 47 expands and contracts to drive the pressurizing pump 30. Accordingly, in order to provide an ink supply pressure, a pressurizing operation for pressurizing the ink cartridges 14 is carried out.

In contrast, when the PF motor 21 is driven in the reverse direction, the atmospheric air release valve 32 is opened by the swing lever 62 rotating in the direction of an arrow B and the lever portion 62*a* pushing the valve opening lever 65 of the atmospheric air release valve 32 inward. Even when the pressurizing pump 30 is driven when the PF motor 21 is driven in the reverse direction, since the atmospheric air release valve 32 is opened, and hence the interior of the ink cartridges 14 is opened to the atmospheric air.

Figure 3:
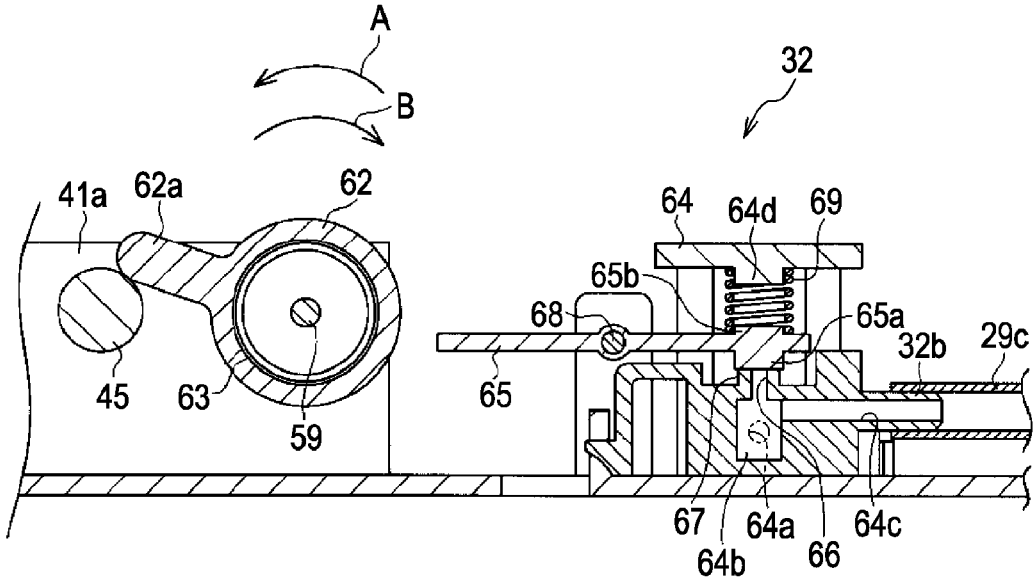
FIG. 3 is a side cross-sectional view showing an atmospheric air release valve in a closed state.
Figure 4:
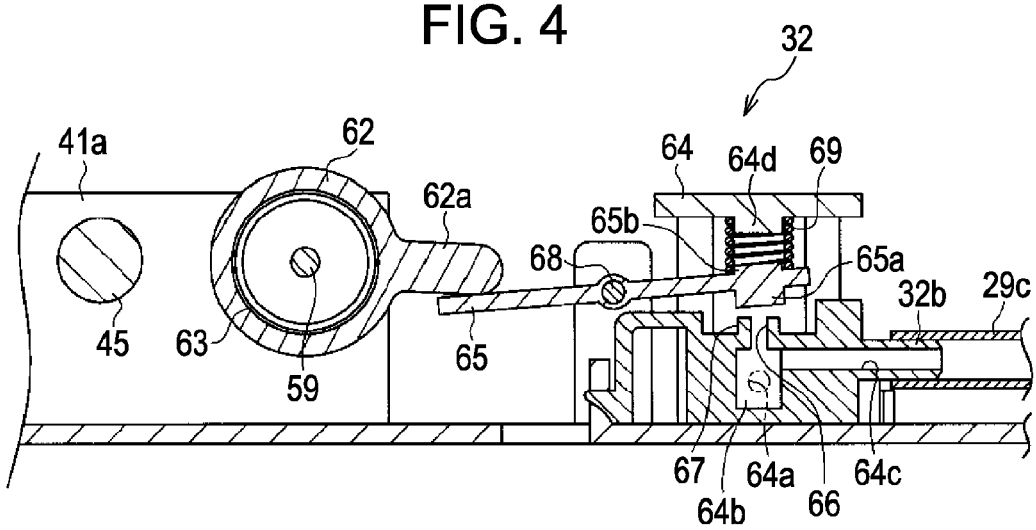
FIG. 4 is a side cross-sectional view showing the atmospheric air release valve in an opened state.

FIG. 3 and FIG. 4 are cross-sectional views showing the operating state of the atmospheric air release valve 32. The atmospheric air release valve 32 is a valve having an atmospheric air releasing function and a regulator function, and includes a valve body 64 having a flow channel of the pressurized air and the valve opening lever 65 for opening and closing an atmospheric air communication channel for bringing the flow channel into communication with the atmospheric air. The valve body 64 includes an intake port 64*a* as an inlet of the pressurized air delivered from the pressurizing pump 30 via the pressure sensor 31, a valve chamber 64*b* which functions as a pressure detection chamber for detecting the pressure of the pressurized air in the valve, and a discharge port 64*c* as an outlet of the pressurized air in the valve.

The valve body 64 is formed with a valve hole 66 which communicates the valve chamber 64*b* and the exterior thereof (atmospheric air), and a valve seat 67 at the peripheral edge of the exit of the valve hole 66. The valve opening lever 65 is pivotably supported by a revolving shaft 68 provided on the valve body 64 so as to extend in parallel with the spindle 59. The valve opening lever 65 is provided with a valve portion 65*a* (valve) which is capable of opening and closing the valve hole 66 at the distal end portion thereof so as to project therefrom.

In contrast, the second spring 69 for urging the distal end portion of the valve opening lever 65 toward the valve hole 66 is provided between the upper wall of the valve body 64 and the valve opening lever 65 in a state of being locked by spring seats 64*d* and 65*b*. A third air supply tube 29*c* extending from the distributor 33 is connected to a discharge connecting pipe 32*b* of the atmospheric air release valve 32.

When the PF motor 21 rotates in the normal direction, the distal end of the lever is inclined downward when the valve opening lever 65 receives an urging force of the second spring 69 as shown in FIG. 3, and the valve portion 65*a* of the valve opening lever 65 closes the valve hole 66, so that the atmospheric air release valve 32 is brought into the closed state. At this time, the swing lever 62 rotates in the direction indicated by an arrow A in FIG. 3 by the normal rotation of the PF motor 21. However, even when the PF motor 21 is continuously rotated in the normal direction, the swing lever 62 comes into abutment with the revolving shaft 45 and hence the swing lever 62 is restrained from rotating thereby in a short time, so that the load generated at this time disconnects the connection of the frictional clutch mechanism 58 to restrain further rotation.

The drive of the pressurizing pump 30 is controlled on the basis of a pressure value Po obtained from a detected value of the pressure sensor 31. The pressurizing pump 30 stops driving of the pump when the pressure value Po is increased to a preset value Pa or higher since the drive of the pump is started, and when the pressure value Po is decreased to a level lower than the preset value Pa, the PF motor 21 starts to rotate in the normal direction, and restarts the drive of the pump. By the repetition of this process, the pressures (air pressures) in the ink cartridges 14 are maintained at a pressure value within a predetermined range.

In contrast, when the pressure value Po is increased excessively and exceeds a threshold value Pb (>Pa) the atmospheric air releasing function of the atmospheric air release valve 32 is activated. At this time, the PF motor 21 is rotated reversely first, and in association with this, the swing lever 62 rotates in the direction indicated by an arrow B in FIG. 3. When the swing lever 62 rotates in the direction indicated by the arrow B to some extent, the lever portion 62*a* of the swing lever 62 comes into abutment with the proximal portion of the valve opening lever 65 as shown in FIG. 4. When the lever portion 62*a* is pushed further downward, the valve opening lever 65 is swung against an urging force of the second spring 69 and the distal end portion of the lever is lifted upward, so that the valve portion 65*a* is moved away from the valve hole 66, thereby opening the atmospheric air release valve 32.

The atmospheric air release valve 32 has the regulator function. A threshold valve Pc (>Pb) to activate the regulator function is set on the basis of the spring force (urging force) of the second spring 69. Therefore, when the pressure value Po of the pressurized air exceeds the threshold valve Pc, the distal end portion of the lever is lifted upward by the air pressure in the valve chamber 64*b* and hence the atmospheric air release valve 32 assumes the opened state spontaneously.

Furthermore, when the power of the printing apparatus 11 is turned OFF, the atmospheric air release valve 32 is opened. It is because keeping the pressurized state in the air supply tubes 29 when the power of the printing apparatus 11 is turned OFF causes problems such that the ink is leaked from the nozzles of the printhead 20 due to environmental changes (temperature change or air pressure change, etc.), the ink cartridges 14 can hardly be demounted, or ink is leaked from the ink discharge ports 35*a* (see FIG. 5) when the ink cartridges 14 are demounted. Therefore, when a power switch 71 (shown in FIG. 5) of the printing apparatus 11 is turned OFF, the PF motor 21 is driven in the reverse direction to open the atmospheric air release valve 32, and then the power is turned OFF. However, in case of occurrence of a paper jam described blow, an exception handling is carried out.

Figure 5:
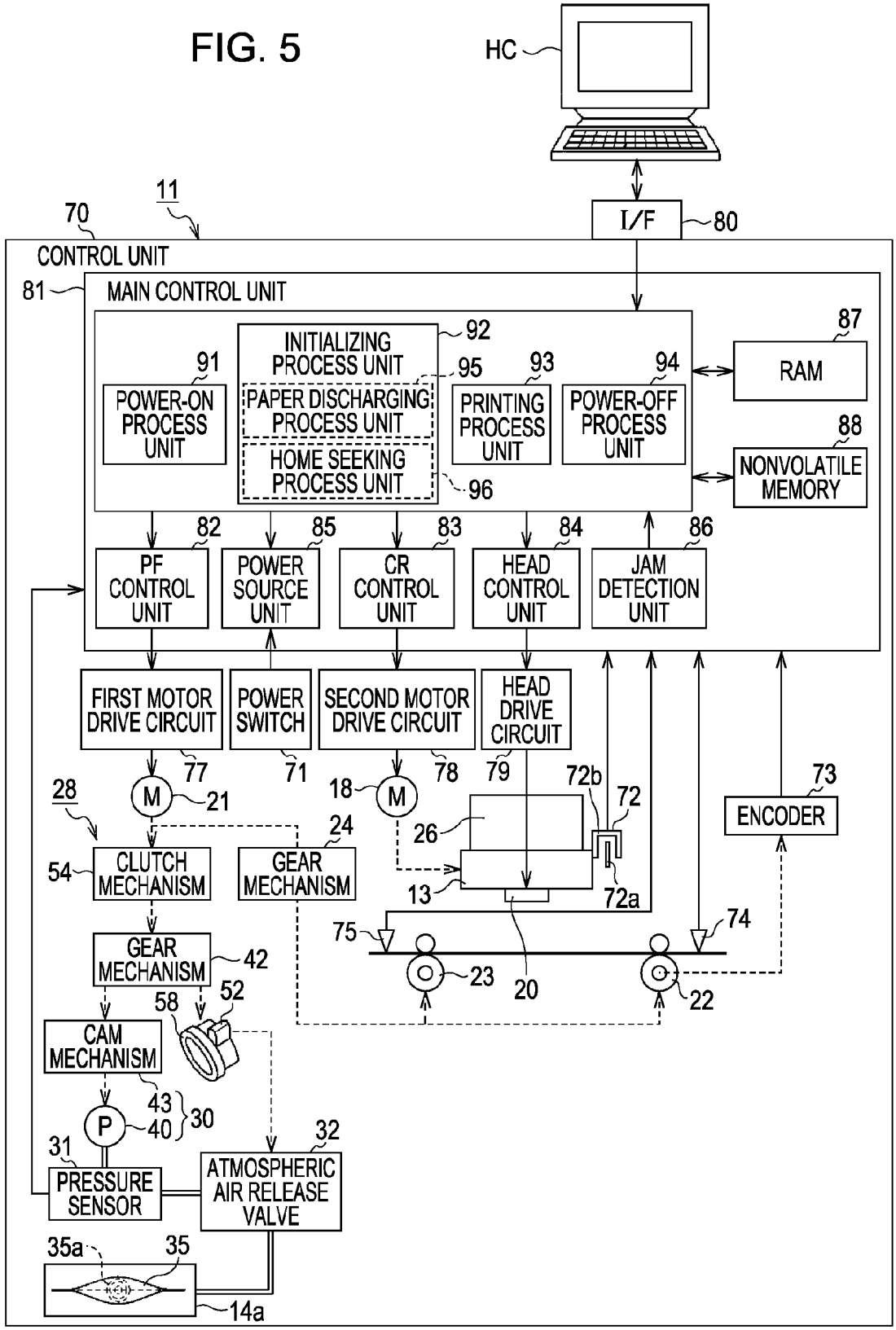
FIG. 5 is a block diagram showing an electric configuration of a printing apparatus.

FIG. 5 is a block diagram showing an electric configuration of the printing apparatus 11. The printing apparatus 11 includes a control unit 70. To the control unit 70, the power switch 71, a linear encoder 72, an encoder 73, a paper detection sensor 74, a paper discharge sensor 75 and, the pressure sensor 31 are connected as an input system, and a first motor drive circuit 77, a second motor drive circuit 78, and a head drive circuit 79 are connected as an output system. The printing apparatus 11 is connected to the host computer HC via an I/F 80, and receives print data from the host computer HC via the I/F 80.

The power switch 71 is an operation switch operated when the power of the printing apparatus 11 is turned ON (power ON) and turned OFF (power OFF).

The linear encoder 72 is a member for detecting the position of the carriage 13 on the moving path, and includes a tape-shaped code panel 72*a* extended along the moving path of the carriage 13 with a tension and being formed with a number of slits at regular pitches, and a sensor 72*b* having a light-emitting unit and a light-receiving unit (both are not shown) on both sides of the code panel 72*a*. The sensor 72*b* has a configuration to output pulses when light emitted from the light-emitting unit and passed through the slits on the code panel 72*a* is received by the light-receiving unit, and outputs encoder signals (pulse signals) having pulses by the number proportional to the amount of movement of the carriage 13.

In this example, the position on a wall surface at an end position on the side of the home position where the carriage 13 comes into abutment with is set as the position of the original point for detecting the position of the carriage 13, and the control unit 70 sets the position of the original point by resetting a counter (not shown) for detecting the position when the carriage 13 is moved and then stopped by coming into abutment with the walls surface in a home seek process from among initializing processes to be carried out when the power is turned ON. Then, by incrementing the counter every time when one pulse is entered from the linear encoder 72 when the carriage 13 is moved in one direction, and decrementing the counter every time when one pulse is entered from the linear encoder 72 when the carriage 13 is moved in the other direction, the position of the carriage 13 in the primary scanning direction X can be grasped from the counted value of the counter. The velocity control of the carriage 13 is carried out using cyclically measured values (values in inverse proportion to the velocity of the carriage) obtained by measuring the pulse cycle of encoder signals from the linear encoder 72.

The encoder 73 is a sensor for detecting the driving amount (amount of rotation) of the PF motor 21 and, for example, includes a rotary encoder. In this example, the rotation of the revolving shaft of the transporting roller 22 is detected to detect the amount of rotation of the PF motor 21 indirectly. For example, a disk-shaped code panel is fixed to an end portion of the revolving shaft of the transporting roller 22 or of another revolving shaft connected to the revolving shaft via a wheel train so as to be capable of integral rotation, and the light passed through a number of the slits formed on the code panel at regular pitches in the circumferential direction is received by the sensor, whereby the encoder 73 outputs encoder signals having the number of pulses proportional to the amount of rotation of the PF motor 21.

The paper detection sensor 74 is a sensor for detecting the paper P at a position on the upstream side in terms of the direction of transportation with respect to the position opposing the printhead 20 in the paper transport path (a position on the upstream side in terms of the direction of transportation with respect to the transporting roller 22 in this example). The paper discharge sensor 75 is a sensor for detecting the paper P at a position on the downstream side in terms of the direction of transportation with respect to the position opposing the printhead 20 in the paper transport path (a position on the downstream side in terms of the direction of transportation with respect to paper discharging roller 23 in this example). If at least one of the paper detection sensor 74 and the paper discharge sensor 75 is in the sensed state, it is recognized that the paper P is present in the transport path. In this embodiment, non-contact sensors (for example, optical sensors) are employed as the respective sensors 74 and 75. However, contact sensors may also be employed.

The control unit 70 includes a main control unit 81, a PF control unit 82, a CR control unit 83, a head control unit 84, a power source unit 85, a jam detection unit 86, a RAM 87, and a nonvolatile memory 88 in the interior thereof. The main control unit 81 is in charge of main control of the printing apparatus 11 including a print control, and issues instructions required for carrying out various processes to the PF control unit 82, the CR control unit 83, and the head control unit 84. For example, the print control is carried out on the basis of the print data that the main control unit 81 receives from the host computer HC via a communication interface (hereinafter, referred to as "I/F 80").

The respective control units 82 to 84 control the drives of the PF motor 21, the CR motor 18, and the printhead 20 respectively via the respective drive circuits 77 to 79 on the basis of the instructions from the main control unit 81. The power source unit 85 converts (AC/DC converts) an alternating current from a power source, not shown, (for example, a commercial AC power source) into a direct current and simultaneously DC/DC converts the same, and supplies a power having predetermined voltages required for the control unit 70 and the respective drive circuits 77 to 79.

The jam detection unit 86 detects the paper jam on the basis of the respective detection signals from the encoder 73, the paper detection sensor 74, and the paper discharge sensor 75. Specifically, the paper jam is detected on the basis of an event such that at least one of the paper detection sensor 74 and the paper discharge sensor 75 is in the paper-detected state even though the PF motor 21 is driven by a predetermined amount of rotation sufficient for discharging the paper P at the time of a paper discharging process.

The main control unit 81 is configured to set a paper jam flag (="1") provided in a predetermined storage area in the RAM 87 or a register (not shown) when the jam detection unit 86 detects the paper jam. When the paper jam is cleared, the paper jam flag is reset (="0"). In this example, the value of the paper jam flag corresponds to jam data. It is also possible to employ data of 2-bit or more as the jam data, and include other data (such as the paper sensing states of the respective sensors 74 and 75 or data on the frequency of occurrence of the jam) on the jam other than the presence or absence of the jam in the jam data.

In this embodiment, the control unit 70 includes a CPU and a ROM or the like, and the main control unit 81, the PF control unit 82, the CR control unit 83, the head control unit 84, and the jam detection unit 86 include software realized by the CPU executing programs stored in the ROM. The respective units 81 to 86 may be hardware including IC circuits such as ASIC (Application Specific Integrated Circuit), or may be achieved by cooperation of software and hardware.

The main control unit 81 include a power-ON process unit 91, an initializing process unit 92, a printing process unit 93, and a power-OFF process unit 94. The power-ON process unit 91 carries out the power-ON process to be carried out when the power switch 71 is turned ON. Here, the power-ON process is a process shown by a flowchart in FIG. 8, described later.

The initializing process unit 92 carries out the initializing process when the power is turned ON. The initializing process unit 92 includes the paper discharging process unit 95 which carries out an automatic paper discharging process when the paper P is detected in the transport path as a part of the initializing process, and a home seeking process unit 96 which carries out the home seek process which is a process for seeking the position of the original point of the carriage 13.

The printing process unit 93 carries out the printing process on the basis of the print data by issuing the instructions to the respective control units 82 to 84.

The power-OFF process unit 94 carries out a power-OFF process to be carried out when the power switch 71 is turned OFF. Here, the power-OFF process is a process shown by a flowchart in FIG. 7, descried later.

Subsequently, according to the flowcharts in FIG. 6 to FIG. 8, the operation of the printing apparatus 11 will be descried.

Figure 6:
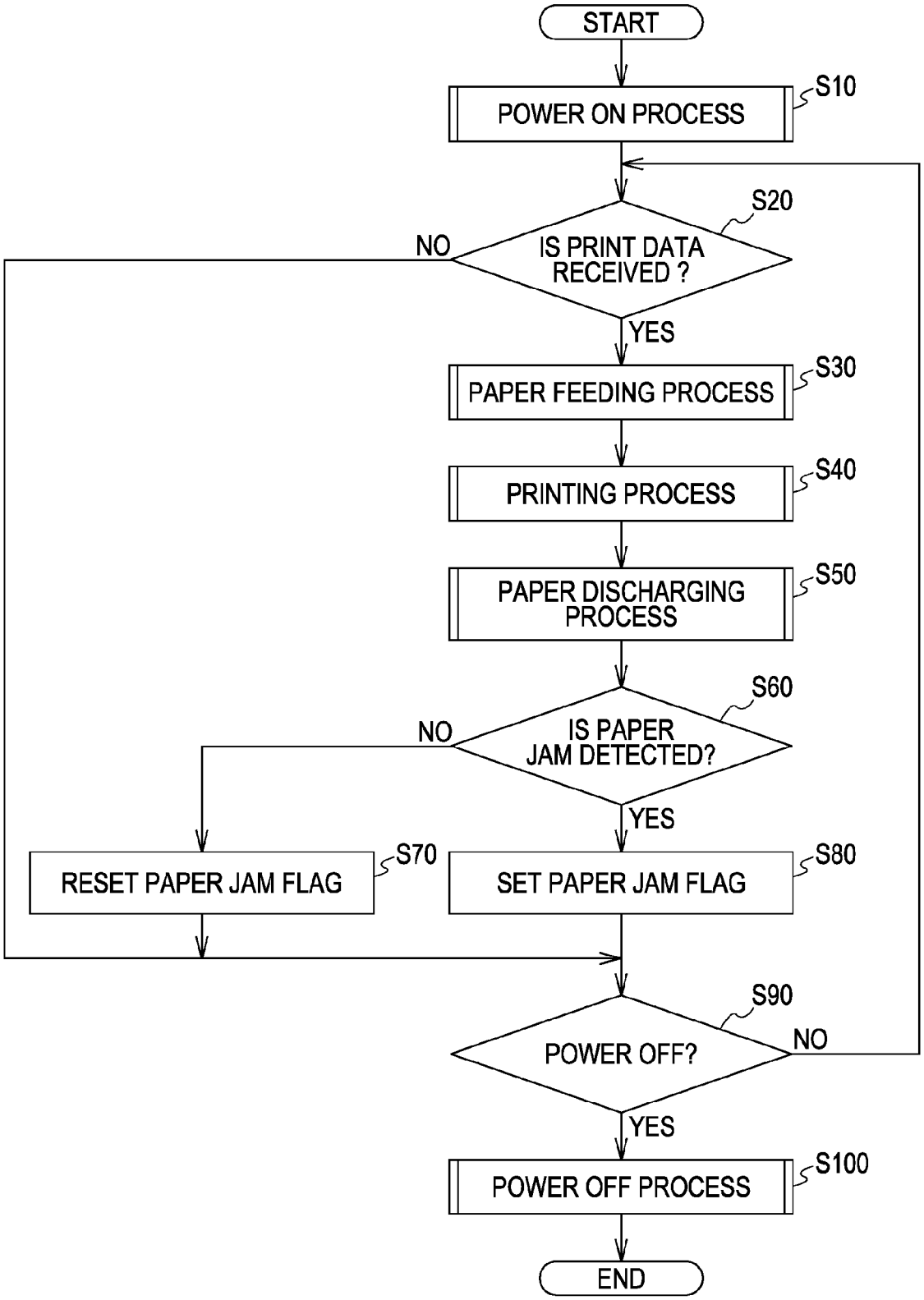
FIG. 6 is a flowchart showing a basic control process of the printing apparatus.

The flowchart shown in FIG. 6 shows a basic control process of the printing apparatus 11. When a user turns ON the power switch 71, and the power of the printing apparatus 11 is turned ON, the control unit 70 carries out the basic control process shown in FIG. 6.

In Step S10, the power-ON process is carried out. In this power-ON process, the power-ON process unit 91 and the initializing process unit 92 carry out the power-ON process routine shown in FIG. 7, described later.

When receiving the print data after having ended the power-ON process (Step S20), the printing process unit 93 of the main control unit 81 carries out the printing process (Steps S30 to S50). First of all, a paper-feeding process is carried out in Step S30, and then the printing process for printing on the paper P supplied in Step S40 is carried out. In the printing process, printing corresponding to one primary scanning line carried out by discharging ink drops from the printhead 20 while driving the CR motor 18 and moving the cartridges 13 in the primary scanning direction X and, simultaneously, and paper feeding of the paper P carried out by driving the PF motor 21 are repeated alternately until receiving a paper discharge command. Then, when the printing process is ended (when the paper discharge command is received), the paper discharging process is carried out in Step S50.

Then, whether or not the paper jam is detected is determined in Step S60. In other words, it is determined that the paper jam is detected when at least one of the respective sensors 74 and 75 is in the sensed state even though the PF motor 21 is driven by a predetermined amount of rotation sufficient for discharging the paper, while it is determined that the paper jam is not detected when both of the respective sensors 74 and 75 are in the non-sensed state. When the paper jam is detected, the paper jam flag is set (flag F=1) (Step S70), and the procedure goes to Step S80. In contrast, when the paper discharging process is ended without detecting the paper jam, the procedure goes to Step S80.

In Step S80, whether or not the power is turned OFF is determined. When the power is turned OFF, the power-OFF process is carried out in Step S70. In other words, the power-OFF process unit 94 carries out a power-OFF process routine shown in FIG. 8, descried later. In contrast, when the power is not turned OFF, the procedure goes back to Step S20. In this manner, while the power is turned ON, the printing process is carried out every time when the printing data is received (S30 to S50), and when the power switch 71 is turned OFF, the power-OFF process is carried out. For example, when the paper jam occurs during the paper discharging process, the user might turn OFF the power switch 71. In this case, the power-OFF process shown in FIG. 7 is carried out. When pages to be printed when the procedure goes back to Step S20, the process from Steps S20 to S90 is carried out until all the pages are printed.

Subsequently, the power-OFF process routine shown in FIG. 7 will be described. When a turn OFF operation signal is entered from the power switch 71, the power-OFF process unit 94 is activated in the main control unit 81, and the power-OFF process routine is carried out.

In Step S110, whether or not the paper jam flag is set is determined. When the paper jam flag is not set (negative determination), a depressurizing operation is started (Step S120). In other words, the PF motor 21 is rotated reversely to open the atmospheric air release valve 32. Consequently, the interior of the air chambers in the ink cartridges 14 are opened to the atmospheric air. Therefore, events such that ink is leaked from the nozzles of the printhead 20 due to the environmental changes because the pressurized air is remaining in the ink cartridges 14 during the power of the printing apparatus 11 is turned OFF, or that ink is leaked from the ink discharge ports 35*a* when the ink cartridges 14 are demounted from the cartridge holder 34 are avoided.

In contrast, when the paper jam flag is set (affirmative determination in Step S110), the depressurizing operation in Step S120 is not carried out. Therefore, an event such that the paper jam (jamming of paper) becomes worse by the transporting roller 22 and the paper discharging roller 23 being driven (reversely in this case) because the PF motor 21 is driven reversely due to the depressurizing operation even though the paper jam occurs is avoided.

Subsequently, in Step S130, paper jam data (paper jam flag data in this example) is stored in the nonvolatile memory 88. Then, other data to be stored is stored in the nonvolatile memory 88. As other data to be stored includes, for example, the accumulated amount of ink consumption by ink colors (or the remaining amount of ink) the time of the day when the power is turned OFF, the heat generation temperature of the motor calculated from the motor current valve used when controlling the limit of heat generation of the motor for limiting the motor driving when the motor generates heat.

When the paper jam is occurred and the power switch 71 is turned OFF, the user removes the paper P and then turns the power switch 71 ON or turns the power switch 71 ON in a state of the paper jam without removing the paper P. When the user turns the power switch 71 ON, the power-ON process routine shown in FIG. 8 is carried out.

Subsequently, the power-ON process routine shown in FIG. 8 will be descried. When a turn ON operation signal is entered from the power switch 71, the power-ON process unit 91 and the initializing process unit 92 are activated in the main control unit 81, and the power-ON process routine is carried out.

In Step S210, data is read from the nonvolatile memory 88. In other words, data stored in the nonvolatile memory 88 when the power is turned OFF, or data such as the paper jam data (paper jam flag value), the accumulated amount of ink consumption (remaining amount of ink), the time of the day when the power is turned OFF, the heat generation temperature of the motor are read.

Subsequently, in Step S220, whether or not the paper jam flag is set is determined. When the paper jam flag is not set (negative determination in S220), the procedure goes to Step S230, where determination of whether the paper is present or not, that is, whether the paper P remains in the transport path is carried out. Here, whether the paper is present or not is determined whether at least one of the paper detection sensor 74 and the paper discharge sensor 75 is in the sensed state or not. When it is determined that the paper is present as a result of determination (positive determination in S230), the procedure goes to Step S240, where the paper discharging process is carried out. In contrast, when it is not determined that the paper is present (that is, when the paper is not present) (negative determination in Step S230) the paper discharging process in Step S240 is not carried out. Here, the paper discharging process is carried out by the paper discharging process unit 95 of the initializing process unit 92 driving the PF motor 21 to rotate in the normal direction. In this case, after having started the drive of the PF motor 21 in the normal direction, the detected states of the both sensors 74 and 75 are monitored, and the drive of the PF motor 21 is stopped after the PF motor 21 is continued to be driven further by a predetermined amount of transportation after the both sensors 74 and 75 have become the non-sensed state or, if at least one of the both sensors 74 and 75 is still in the sensed state, the drive of the PF motor 21 is stopped after having ended the drive by a predetermined amount of rotation sufficient for discharging the paper from the start of the drive. However, since the paper discharging process is performed when the paper jam is not occurred, the paper P is basically discharged by the paper discharging process in Step S240. In this manner, the reason why the paper discharging process is carried out when the paper is present is for avoiding such an event that the home seek process cannot be performed adequately by being hindered by the paper P when carrying out the home seek process in the subsequent Step S270.

In contrast, when the paper jam flag is set in S220, whether or not the paper jam is cleared is determined in Step S250. In other words, whether or not the both sensors 74 and 75 are both in the non-sensed state, and when the both sensors 74 and 75 are both the non-sensed state, it is determined that the paper jam is cleared. When the paper jam is not cleared, an error notification (for example, illumination or flashing of an alarm LED or the like) is prompted to urge the user (Step S260) to clear the paper jam. In contrast, when the paper jam is cleared, the home seek process in Step S270 is carried out. In this manner, the home seek process in Step S270 is carried out when the fact that there is no paper P present in the transport path is confirmed such as when the paper jam occurred at the time of the last turning OFF of the power in the previous time is cleared (affirmative determination in S250), and when the paper is removed in the paper discharging process when the paper jam is not occurred but the paper is remaining (for example, when the power is turned OFF during the printing job) (S240).

The home seek process in Step S270 is carried out by the home seeking process unit 96 in the initializing process unit 92. In other words, the home seeking process unit 96 drives the CR motor 18 and moves the carriage 13 until it comes into abutment with the wall surface at the end position on the side of the home position. Then, the position of the end wall surface where the carriage 13 is stopped by coming into abutment with is grasped while monitoring the encoder signal entered from the linear encoder 72 and the counter for detecting the stopped position is reset, whereby the stopped position is set as the original position of the carriage 13.

Here, assuming that the home seek process is carried out in the state of the paper jam, the carriage 13 comes into abutment with the jammed paper P, and hence the position of the abutment might be set erroneously as the original position. Therefore, in this embodiment, the home seek process is not carried out when the paper jam is not cleared (negative determination in S250). Therefore, an event that the original position of the carriage 13 is erroneously set during the home seek process is avoided.

Then, when the home seek process is ended, the pressurizing operation is carried out in the subsequent Step S280. That is, the main control unit 81 issues an instruction to the PF control unit 82 to drive the PF motor 21 to rotate in the normal direction. In the case of this example, the carriage 13 presses the clutch lever 56 inward at the switching position at the time when the home seek process is ended. However, if not, the CR motor 18 is driven to move the carriage 13 to the switching position, and then the drive of the PF motor 21 in the normal direction is started simultaneously with the drive of the CR motor 18. Consequently, the PF motor 21 is driven in the normal direction with the clutch mechanism 54 connected, so that the swing lever 62 is rotated in the direction indicated by an arrow A in FIG. 3 at the initial stage of the drives, so that the atmospheric air release valve 32 is closed. In addition, by the PF motor 21 being continuously driven in the normal direction with the atmospheric air release valve 32 closed, the pressurizing pump 30 is driven, so that the pressurized air is supplied to the air chambers in the ink cartridges 14. Then, when the pressure value Po obtained from the detected value of the pressure sensor 31 is increased to a value equal to or larger than the preset pressure Pa ($Po \geqq Pa$), the drive of the PF motor 21 in the normal direction is stopped. In this manner, the ink packs 35 in the ink cartridges 14 are pressed at the preset pressure Pa and hence ink is supplied from the ink discharge ports 35*a* thereof at a predetermined supply pressure. Subsequently, other initializing processes are carried out in Step S290. The other initializing processes may be carried out in the first Step of the power-ON process routine, or in the Step next to the Step (S210) of a data reading process, that is, may be carried out at an adequate timing according to the content of the initializing process. The other initializing processes may be carried out separately in the first and the last steps with the intermediary of the paper discharging process (S240), the home seek process (S270), and the pressurizing operation (S280) as a matter of course.

In this manner, when the paper jam is not cleared, neither the home seek process nor the pressurizing operation is carried out, and hence the inconveniences such as damage to mechanical portions of the apparatus or difficulty of removal of the jammed paper caused by driving the PF motor 21 to rotate in the normal direction for the pressurizing operation, which might make the paper jam worse, are avoided.

When the paper discharging process in S240 is carried out, whether it is carried out under the condition that the carriage 13 is positioned at the switching position or under the condition that the carriage 13 is not positioned at the switching position may be selected as desired. For example, in the former case, since the atmospheric air release valve 32 is closed by the PF motor 21 being driven to rotate in the normal direction at the time of the paper discharging process and the pressurization to some extent is achieved, only the remaining pressurization needed to increase the pressure value Po obtained from the detected value of the pressure sensor 31 to a value equal to or larger than the preset pressure Pa is required in the pressurizing operation in S280, so that only a small amount of driving of the PF motor 21 is required at the time of the pressurizing operation. Here, the amount of the drive of the PF motor 21 in the normal direction required for the paper discharging process depends on the current position of the paper P in the transport path. On the other hand, the amount of the drive of the PF motor 21 in the normal direction required for the pressurizing operation depends on the current remaining amount of ink because the capacities of the air chambers in the ink cartridges 14 depend on the remaining amounts of ink in the ink packs 35. Therefore, when the amount of drive of the PF motor 21 required for the pressurizing operation is smaller than the amount of drive of the PF motor 21 required for the paper discharging process, it is preferable not to arrange the carriage 13 at the switching position at the time of paper discharging process in S240 in order to avoid the pressure values Po in the ink cartridges 14 from being excessively high when the paper discharging process is ended.

Also, when the error notification is given, the user removes the jammed paper P and then presses a predetermined operation button (operation switch) provided on the printing apparatus 11, whereby the main control unit 81 carries out the initializing process (including the home seek process and the pressurizing process).

As described above in detail, the following advantages are provided according to the embodiment of the invention.

(1) If it is determined when the power is turned ON from the paper jam flag that the paper jam was occurred when the power was turned OFF last time, and is determined from the result of detection of the sensors 74 and 75 when the power is turned ON that the paper jam is not yet cleared, the pressurizing operation is not carried out. Therefore, an event of making the paper jam worse because the pressurizing operation to drive the PF motor 21 to rotate in the normal direction is carried out is avoided. Consequently, an event such as damage to the mechanical portion of the printing apparatus 11 or difficulty of removal of the jammed paper P may be avoided.

(2) When it is determined when the power is turned ON that the paper jam is solved, the pressurizing operation is carried out. Therefore, the user is not obliged to make a troublesome operation such as the operation of the operation button for notifying the fact that the paper jam is cleared to the printing apparatus 11. Therefore, when the power is turned OFF in the state of the paper jam and then is turned ON after having cleared the paper jam, the initializing process is entirely carried out in the same manner as when the power is turned ON after having turned OFF under the normal state. Therefore, the printing job can be started soon after the power-ON operation.

(3) When the paper jam was not occurred at the time of the last power-OFF operation (the paper jam flag set), when it is determined that the paper P is not present in the transport path from the results of detection of the respective sensors 74 and 75, the home seek process is carried out as is. In contrast, when there is the paper P present in the transport path, the paper discharging process is carried out to remove the paper P from the transport path and then the home seek process is carried out. Therefore, an inconvenience such as setting the position where the carriage 13 comes into abutment with the paper P erroneously as the original position because the home seek process is carried out in the state in which the paper P is present in the transport path is avoided.

(4) When the paper jam is not cleared when the power is turned ON, the home seek process is not carried out. In contrast, when the paper jam is cleared, the home seek process is carried out. Therefore, even when the paper jam is occurred at the time of the last power-OFF operation, the home seek process can be carried out without operating the button for notifying the fact that the paper jam is cleared as long as the paper jam is cleared at the time of the power-ON operation. Therefore, the printing job can be started soon after the power-ON operation.

(5) When the paper jam flag is set at the time of the power-OFF operation and it is determined that the paper jam is occurred, the depressurizing operation is not carried out. In contrast, when the paper jam flag is not set, the depressurizing operation is carried out. Therefore, an event of making the paper jam worse because the depressurizing operation is carried out when the power is turned OFF in the state of the paper jam is avoided.

Second Embodiment

Subsequently, a second embodiment will be described. The second embodiment is an example in which the invention is applied to a printing apparatus (recording apparatus) having an ink supply mechanism in which the ink cartridges are arranged at a position higher than the printhead, and ink is supplied from the ink cartridges to the printhead utilizing the hydrocephalic difference.

Figure 9:
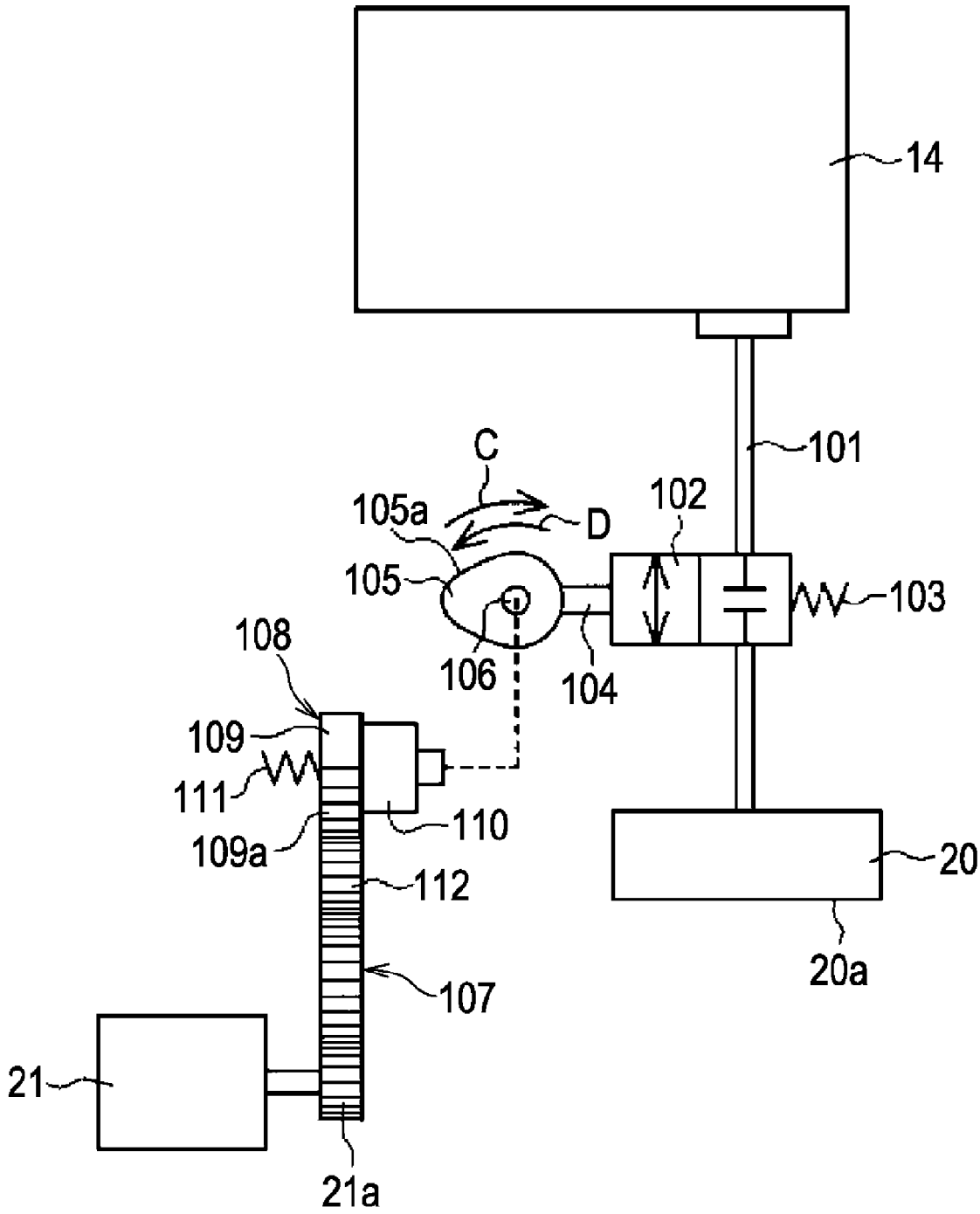
FIG. 9 is a schematic side view showing an ink supply mechanism according to a second embodiment.

As shown in FIG. 9, the ink cartridges 14 are each arranged in such a manner that the supply port thereof is located above a nozzle opening surface 20*a* of the printhead 20 by a predetermined distance. An opening-closing valve 102 is provided at a midpoint of each ink tube 101 extending downward from the ink cartridge 14. The opening-closing valve 102 is urged by a spring 103 in the closing direction, and a cam follower 104 is provided at an end position opposite from the each spring 103 in the direction of the valve stroke. A rotary cam 105 (eccentric cam) is arranged at a position next to the each cam follower 104, and a cam surface 105*a* (outer peripheral surface) thereof is in abutment with the cam follower 104. A revolving shaft 106 of the each rotary cam 105 is eccentrically positioned. The pinion gear 21*a* fitted on the output shaft of the PF motor 21 as a drive source is connected to the each revolving shaft 106 via a gear train 107 and a frictional clutch 108 so as to be capable of transmitting the power. When the PF motor 21 is driven to rotate in the normal direction, the each opening-closing valve 102 is opened by the rotary cam 105 rotated from the state shown in FIG. 9 in the normal direction indicated by an arrow C. When the PF motor 21 is driven to rotate in the reverse direction from the opened state, the each rotary cam 105 is rotated reversely in the direction indicated by an arrow D, so that the opening-closing valve 102 is closed as shown in FIG. 9. The frictional clutch 108 is urged into a frictional engagement by a gear 109 having a tooth portion 109*a* including a part where the teeth are missing and a cylinder 110 urged by a spring 111 in the direction to press contact surfaces thereof to each other, and the rotation of the cylinder 110 is transmitted to the revolving shaft 106 of the rotary cam 105. With the reciprocating rotation of the cylinder 110 within a range in which the gear 112 and the tooth portion 109*a* of the gear 109 including the part where the teeth are missing are able to engage, the rotary cam 105 is rotated in the normal direction and the reverse direction within the predetermined angle of rotation, whereby the opening and closing of the opening-closing valves 102 are enabled.

Figure 7:
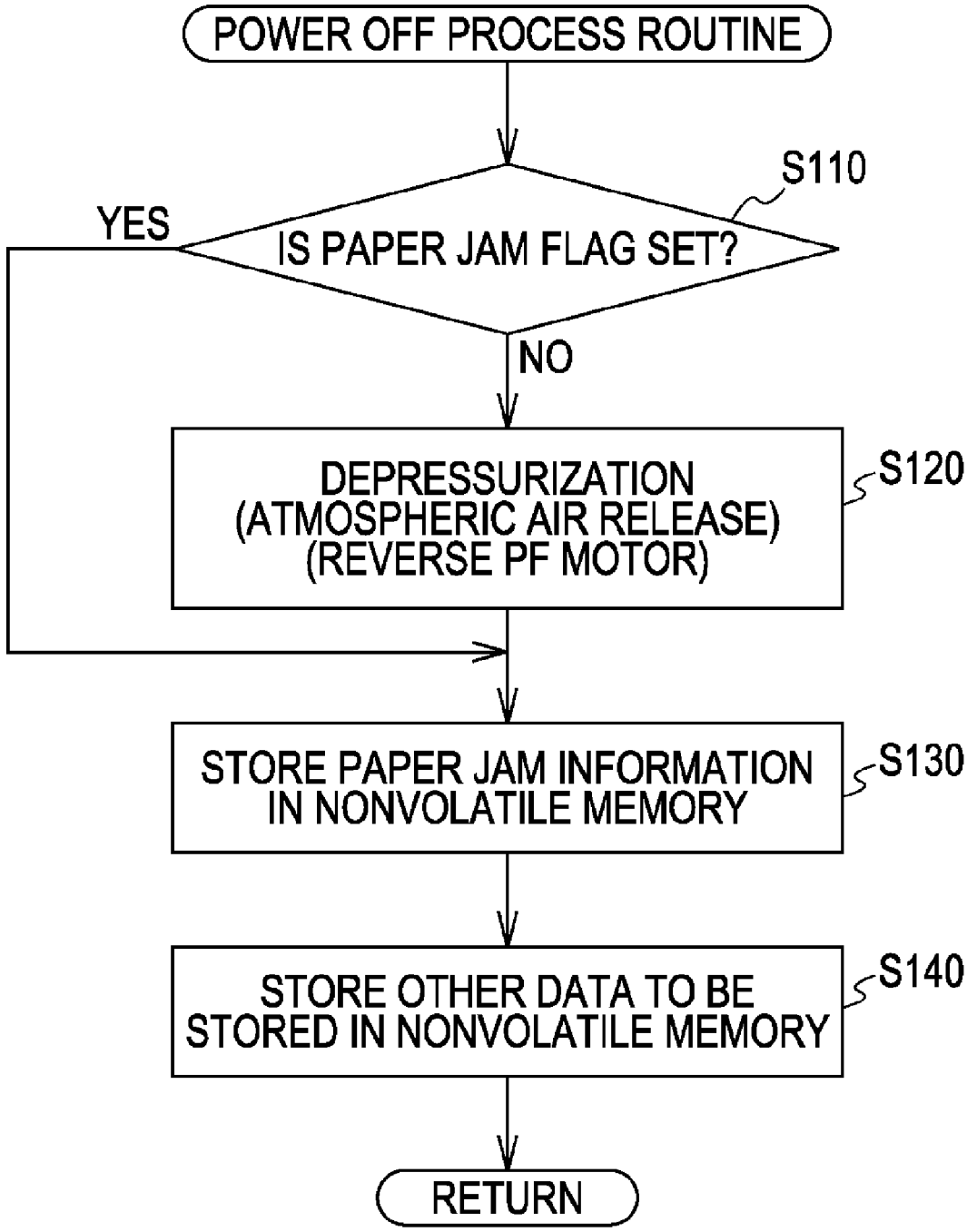
FIG. 7 is a flowchart showing a power-OFF process routine.
Figure 8:
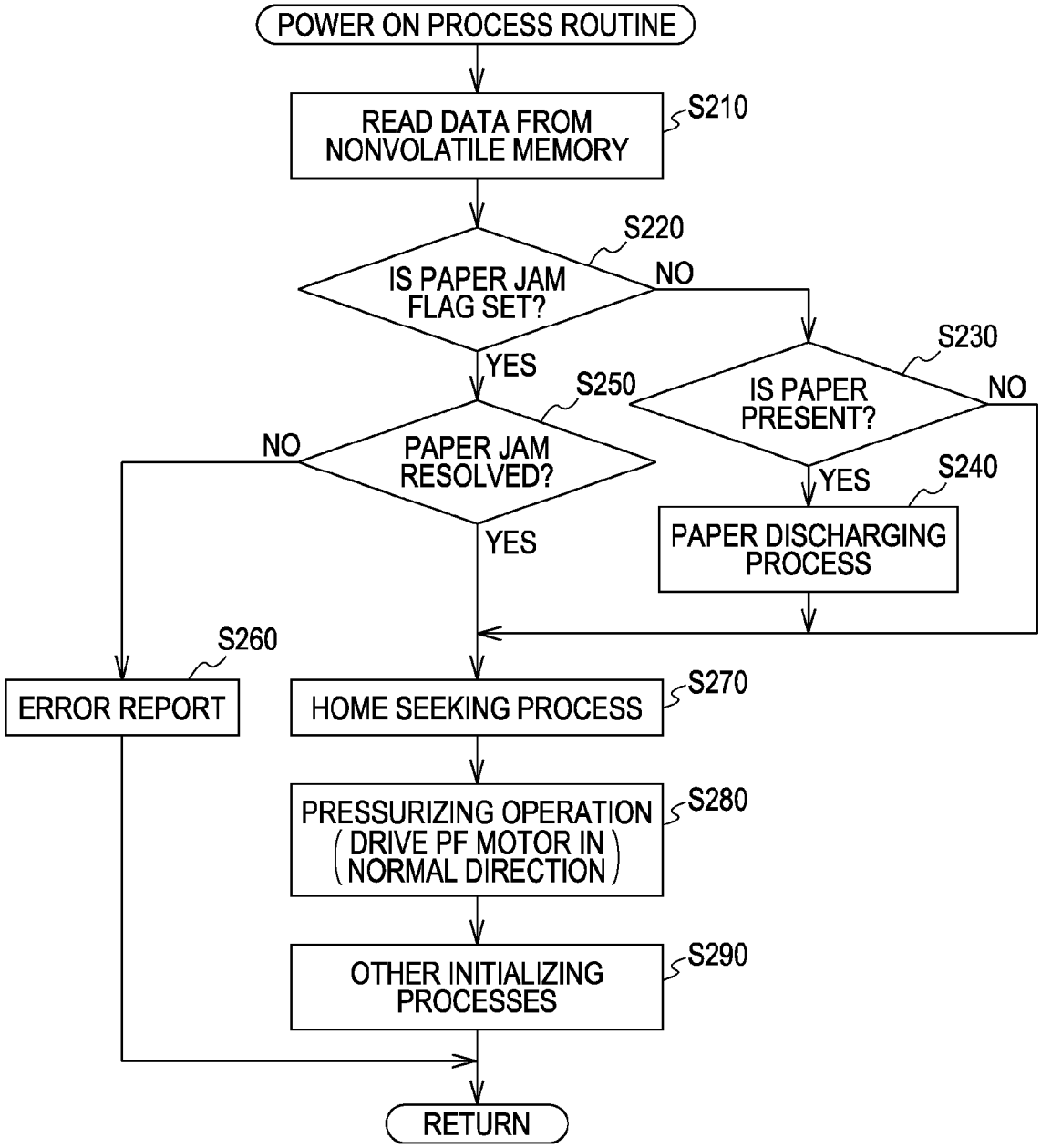
FIG. 8 is a flowchart showing a power-ON process routine.

In the printing apparatus having the ink supply mechanism utilizing the hydrocephalic difference, the control unit performs the processes shown in FIGS. 6 to 8. However, due to the difference in ink supply system, the process in Step S120 in the power-OFF process routine shown in FIG. 7 is a process to switch the ink supply mechanism into an ink supply state by closing the opening-closing valves 102 by driving the PF motor 21 to rotate in the reverse direction instead of the depressurizing operation. Also, the process in Step S280 in the power-ON process routine shown in FIG. 8 is a process to switch the ink supply mechanism into an ink non-supply state by closing the opening-closing valves 102 by driving the PF motor 21 to rotate in the normal direction instead of the pressurizing operation. In the printing apparatus having the ink supply mechanism utilizing the hydrocephalic difference, the same advantages as the first embodiment are achieved by the employment of the power-OFF process routine and the power-ON process routine. In this embodiment, the fluid supply adjusting unit for switching the supply and non-supply of ink (fluid) from the ink cartridges 14 as the fluid supply sources to the printhead 20 as the recording unit includes the opening-closing valves 102 as the valve units, the rotary cams 105, and the frictional clutch 108 or the like. Also, as long as it is the ink supply mechanism utilizing the hydrocephalic difference, the configuration in FIG. 9 may be applied to the printing apparatus of an ON-carriage type in which the ink cartridges are mounted on the carriage.

The embodiments are not limited to the configuration described above, and may be modified as follows.

Modification 1

Figure 10:
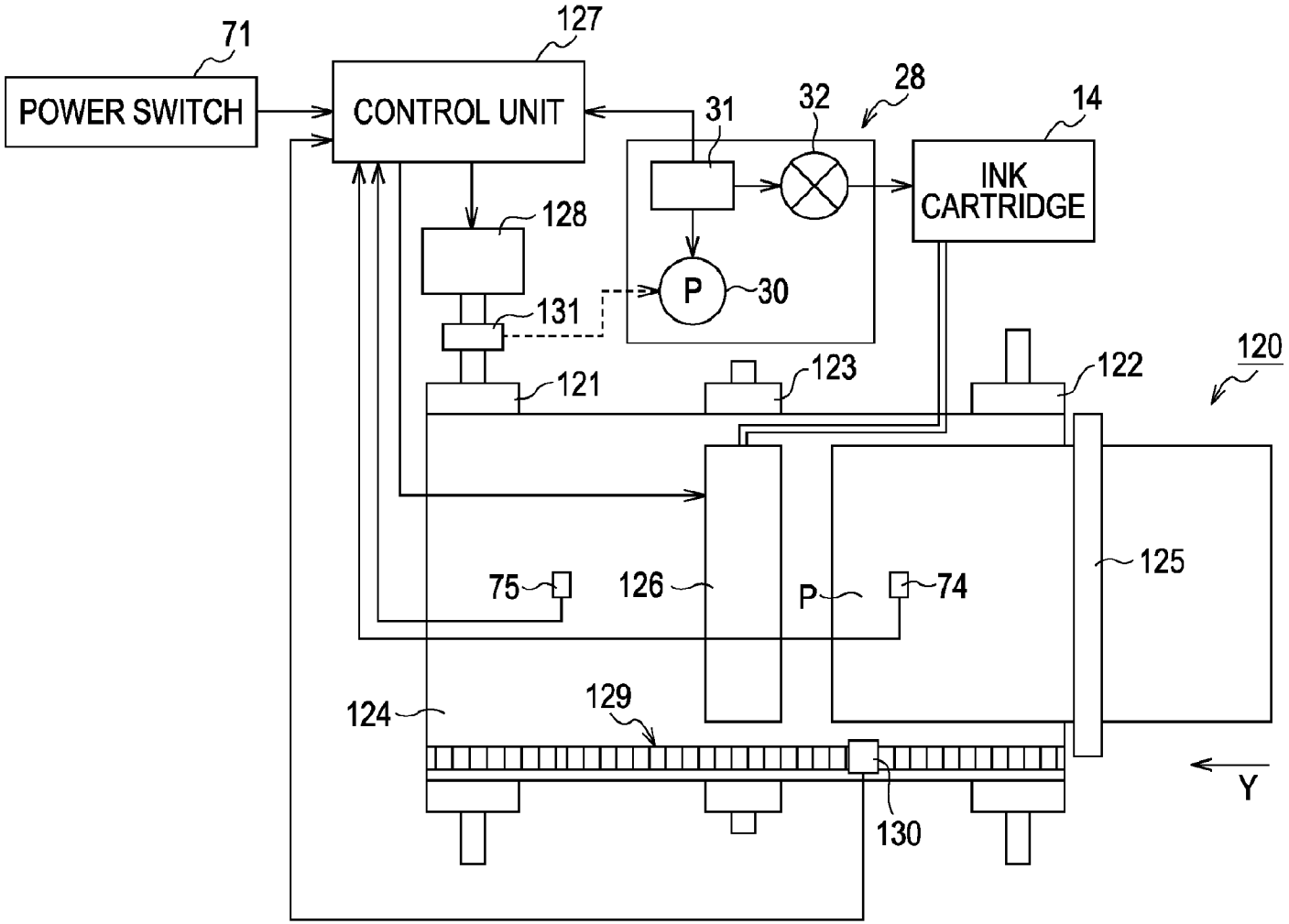
FIG. 10 is a schematic plan view of a line printer according to a modification.

The recording apparatus is not limited to the serial printer. For example, the invention may be applied to a line printer as shown in FIG. 10. As shown in FIG. 10, a line printer 120 as the recording apparatus receives the supply of the paper P onto a transporting belt 124 wound around a plurality of rollers 121 to 123 via a roller 125. Provided above the substantially center portion of the transporting belt 124 in the transporting direction at a position upward (toward the near side in the direction orthogonal to the paper plane of FIG. 10) away the belt surface by a predetermined gap is a printhead 126. The printhead 126 includes a nozzle set positioned in a range across the entire area of the maximum paper width and, in this example, it is so-called a multi-head type including a plurality of printheads. However, the type having only a single printhead is also applicable. By driving a transporting motor 128 (PF motor) as the drive source by a control unit 127 shown in FIG. 10, the paper P is transported in the transporting direction Y (leftward in FIG. 10) on the transporting belt 124 at a constant velocity. Then, printing on the paper P is achieved by ink drops being discharged from the printhead 126 onto the paper P being transported at the constant velocity. A linear encoder 129 is provided at a side edge portion of the transporting belt 124, and the timing of discharge from the printhead 126 is controlled on the basis of the discharge timing signals generated on the basis of encoder pulses outputted from a sensor 130 of the linear encoder 129.

In this example, a clutch mechanism 131 for switching the power transmission path from the transporting motor 128 to the pressurizing unit 28 between connection and disconnection is interposed between the transporting motor 128 and the roller 121. The clutch mechanism 131 includes, for example, an actuator (not shown) such as an electromagnetic clutch, and is switched by the control unit 127. The pressurizing unit 28 has the same configuration as the one shown in the first embodiment, and includes the pressurizing pump 30, the pressure sensor 31, and the atmospheric air release valve 32 (see FIG. 1 and FIG. 2). When turning the power switch 71 ON, the control unit 127 switches the clutch mechanism 131 into the connected state, and drives the transporting motor 128 in the direction of rotation when transporting the paper (for example in the normal direction), so that the atmospheric air release valve 32 is closed, and the pressurizing pump 30 is driven, and the pressurizing operation is carried out. Subsequently, when the detected value (pressure value Po) of the pressure sensor 31 reaches the preset pressure Pa, connection of the clutch mechanism 131 is disconnected, and the pressurizing operation is stopped. In contrast, when turning the power switch 71 OFF, the control unit 127 drives the transporting motor 128 in the direction opposite from the direction of rotation when transporting the paper (for example, in the reverse direction) in a state in which the first clutch inner 131 is connected, and the atmospheric air release valve 32 is opened, so that the air chambers in the ink cartridges 14 are released to the atmospheric air. Also, the paper detection sensor 74 for detecting the presence or absence of the paper P transported on the transporting belt 124 at the position on the upstream side of the printhead 126 in terms of the transporting direction, and the paper discharge sensor 75 for detecting the same at the position on the downstream side of the printhead 126 in terms of the transporting direction. Then, the control unit 127 having basically the same configuration as the control unit 70 shown in FIG. 5 carries out the processes in FIG. 6 to FIG. 8 (provided that it is a line-recording system), on the basis of the paper jam flag or the detected results of the respective sensors 74 and 75.

Modification 2

A configuration in which when the paper jam is occurred on the basis of data indicated by the paper jam flag (jam data) when the power is turned ON, the pressurizing operation is always prohibited without determining the clearance of the paper jam is also applicable. In this case, a configuration in which the pressurizing operation is carried out after the user has notified the clearance of the jam by operating a button may be employed.

Modification 3

The direction of rotation of the PF motor 21 as the drive source for driving the pressurizing pump 30 is not limited to be the same as the direction of rotation when discharging the paper (normal direction). For example, a configuration in which the pressurizing pump is driven by driving the PF motor 21 to rotate in the direction opposite from the direction of rotation for the time of the paper-discharging process is also applicable. In this configuration as well, the paper jam is prevented from being made worse both when the power is turned OFF and the power is turned ON.

Modification 4

In a printer having a structure which can hardly make the paper jam worse when the drive source is driven in the direction opposite from the direction of paper discharge, the operation carried out by driving the PF motor 21 in the direction opposite from the direction of paper discharge from between the depressurizing operation and the pressurizing operation may be carried out when the power is turned OFF or when the power is turned ON even in the state of the paper jam. For example, in the first embodiment, the depressurizing operation may be carried out when the power is turned OFF. In this case, since the driving amount (the amount of rotation) of the drive source (PF motor 21) required for opening the valve unit (atmospheric air release valve 32) for the depressurizing operation may be significantly smaller than the driving amount of the drive source required for driving the pressurizing pump 30 until the completion of the pressurizing operation, particularly, the paper jam cannot be made worse.

Modification 5

The pressurizing pump is not limited to the bellows-type pump. For example, a diaphragm-type pump, a tube pump, or a gear pump may be used.

Modification 6

When the paper is jammed, the depressurizing operation when the power is turned OFF and the pressurizing operation when the power is turned ON are both prohibited. However, a configuration in which one of those is prohibited is also employed.

Modification 7

In the embodiments described above, the invention is embodied in the ink jet type printer as an example of the recording apparatus. However, the invention is also applicable to a fluid ejecting apparatus having an ink jet type printhead other than the printer. For example, the invention may be embodied in the fluid ejecting apparatus for ejecting fluid other than ink (including liquid, liquid-state substance including particles of functional material dispersed or mixed in liquid, fluid-like substance such as gel, and solid substance which can be ejected by flowing as the fluid). For example, it may be a liquid-state ejecting apparatus for ejecting liquid-state substance including materials such as electrode material or color material (pixel material) used for manufacturing a liquid crystal display, an EL (electroluminescence) display and a surface emission-type display in the form of dispersion or dissolution, a liquid ejecting apparatus which ejects biological organic substance used for manufacturing biochips, or a liquid ejecting apparatus used as a precision pipette for ejecting liquid used as a sample. Furthermore, it may be a liquid ejecting apparatus for ejecting lubricant for pinpoint lubrication for precise machines such as watches or cameras, a liquid ejecting apparatus for ejecting transparent resin liquid such as UV-cured resin or the like on a substrate for forming micro-semispherical lens (optical lens) used for optical communication elements or the like, a liquid ejecting apparatus for ejecting etching liquid such as acid or alkali for etching the substrate or the like, a fluid-like substance ejecting apparatus for ejecting the fluid-like substance such as gel (for example, physical gel) or a powder particle ejecting apparatus for ejecting slid substance such as powder (powder particle) such as toner (for example, toner-jet-type recording apparatus). The invention may be applied to any one of these fluid ejecting apparatus (recording apparatus). In this specification, the term "fluid" has a concept which does not include fluid including only gas, and the "fluid" includes, for example, liquid (inorganic solvent, organic solvent, solution, liquid-state resin, liquid-state metal (melted metal)) liquid-state material, fluid material, powder particle material (including particles and powder).

A technical idea grasped from the embodiments and respective modifications will be descried below.

According the embodiments and modifications of the invention, the fluid supply adjusting unit includes the pressurizing pump (30) and a valve unit (32), the pressurizing pump is for pressurizing the fluid supply source for providing a fluid supply pressure to the fluid supply source, the valve unit is a valve for opening and closing a pressurized fluid supply channel (29) for connecting the pressurizing pump and the fluid supply source, and the direction of driving in which the drive source discharges the target is the direction in which the pressurizing pump carries out the pressurization and the direction that the valve unit is closed.

What is claimed is:

1. A recording apparatus having a transporting unit configured to transport a target and a recording unit configured to carry out recording on the target transported by the transporting unit comprising:

a fluid supply adjusting unit configured to switch an operation between supply and non-supply of fluid from a fluid supply source;

a drive source for the transporting unit and the fluid supply adjusting unit;

a control unit configured to control the drive of the drive source;

a jam detection unit configured to detect a jam of the target on a transport path of the transporting unit;

a storage unit configured to retain jam data based on the jam detection unit; and a determining unit configured to determine the presence or absence of occurrence of the jam at the time of the last power-OFF operation on the basis of the jam data in the storage unit when the power of the recording apparatus is turned ON, wherein the fluid supply adjusting unit includes a pressurizing pump configured to be driven by the drive source and carry out a pressurizing operation, and the direction of drive of the power source for the pressurizing pump is corresponding to the direction of drive of the power source for transporting unit when in discharging the target, wherein the control unit carries out a first control or a second control according to the detection of the jam by the jam detection unit when the power is turned OFF and carries out a third control or a fourth control according to the state of occurrence of the jam determined by the determining unit when the power is turned ON, the first control; when the jam is not detected, after driving the drive source in the direction to stop the supply of the fluid, turning the power of the recording apparatus OFF, the second control; when the jam is detected, turning off the power of the recording apparatus without carrying out the drive of the drive source for stopping the supply of the fluid, the third control; when the jam is not occurred, driving the drive source for causing the recording unit to supply the fluid, and the fourth control; when the jam is occurred, not driving the drive source for supplying the fluid.

2. The recording apparatus according to claim 1, further comprising a moving unit configured to move the recording unit in the direction intersecting the transporting direction of the target;

a position detecting unit configured to detect the position of the recording unit on a moving path;

an original point detecting unit configured to detect the fact that the recording unit is positioned at an original point on the moving path; and a target detecting unit configured to detect the presence of the target on the transport path, wherein the control unit is configured to carry out a home seek process for driving the moving unit to move the recording unit and setting the position of the recording unit on the moving path detected by the original point detecting unit to an original point as one of an initializing process to be carried out when the power is turned ON, and wherein when the power is turned ON, the control unit;

carries out the drive of the drive source for carrying out an target discharging process and the pressurizing operation and carries out the home seek process after the target detecting unit detects that the target is not present on the transport path if the target is present on the transport path at that time, and carries out the pressurizing operation and the home seek process if the target is not present on the transport path at that time when the jam is not occurred; and carries out neither the pressurizing operation nor the home seek process on the basis of the result of determination determined by the determining unit and the result of detection detected by the target detecting unit when the jam is occurred.

3. The recording apparatus according to claim 2, wherein the fluid supply adjusting unit includes a valve unit configured to be driven by a power of the drive source of the transporting unit and to be opened and closed for switching the supply of the fluid from the fluid supply source to the recording unit between supply and non-supply, and wherein the control unit switches the supply of the fluid to the non-supply state by closing the valve unit by driving the drive source in the direction to close the valve unit when the jam detection unit does not detect the jam when the power is turned OFF, and does not carry out the drive of the drive source to be carried out for closing the valve unit when the jam detection unit detects the jam.

* * * * *